US009334075B2

(12) United States Patent
Kuismanen

(10) Patent No.: US 9,334,075 B2
(45) Date of Patent: May 10, 2016

(54) DISCHARGE DEVICE FOR AN ELASTIC PACKING CONTAINER AND METHOD FOR DISCHARGING AN ELASTIC CONTAINER

(75) Inventor: Esa Kuismanen, Tornio (FI)

(73) Assignee: OY PRO-HYDRO AB, Tornio (FI)

( * ) Notice: Subject to any disclaimer, the term of this patent is extended or adjusted under 35 U.S.C. 154(b) by 5 days.

(21) Appl. No.: 14/342,625

(22) PCT Filed: Aug. 30, 2012

(86) PCT No.: PCT/FI2012/050837

§ 371 (c)(1),
(2), (4) Date: Mar. 4, 2014

(87) PCT Pub. No.: WO2013/030455

PCT Pub. Date: Mar. 7, 2013

(65) Prior Publication Data

US 2014/0217118 A1 Aug. 7, 2014

(30) Foreign Application Priority Data

Sep. 2, 2011 (FI) ..... 20115866

(51) Int. Cl.

| | |
|---|---|
| ***B65D 35/28*** | (2006.01) |
| ***B65B 69/00*** | (2006.01) |
| ***B67D 7/02*** | (2010.01) |

(52) U.S. Cl.

CPC ..... *B65B 69/005* (2013.01); *B67D 7/0216* (2013.01)

(58) Field of Classification Search

CPC ... B65B 69/005; B65B 35/285; B67D 7/0216
USPC ..... 222/102
See application file for complete search history.

(56) References Cited

U.S. PATENT DOCUMENTS 1,927,278 A * 9/1933 Clark ..... 222/98
2,003,283 A 6/1935 Chatelain (Continued)

FOREIGN PATENT DOCUMENTS

| | | |
|---|---|---|
| EP | 0143376 | 6/1985 |
| GB | 2154977 | 9/1985 |
| WO | 2011/080402 | 7/2011 |

OTHER PUBLICATIONS

International Search Report dated Nov. 15, 2012, corresponding to PCT/FI2012/050837.

(Continued)

*Primary Examiner* — Patrick M Buechner
*Assistant Examiner* — Jeremy W Carroll
(74) *Attorney, Agent, or Firm* — Young & Thompson

(57) ABSTRACT

Discharge device for discharging a container containing viscous substances and having an elastic shell material, has a winding roller, a counter pressure roller, an actuator for rotating the winding roller and a control part for controlling the actuator. The inner part of the winding roller is hollow and includes therein an attaching arrangement, where the shell material of the container to be discharged is attached. The shell of the winding roller has an opening, in which opening there is a lid part having a shape for the shell material of the container attached to the attaching arrangement. The winding roller is rotated so that the shell material of the container attached to the attaching arrangement is wound around the winding roller. The winding roller and counter pressure roller are pressed against each other so that the shell material of the container winding around the winding roller passes between the rollers.

21 Claims, 3 Drawing Sheets

(56) References Cited

U.S. PATENT DOCUMENTS

| | | | | | |
|---|---|---|---|---|---|
| 2,502,081 | A | | 3/1950 | Flynn et al. | |
| 2,932,431 | A | * | 4/1960 | Lipton | 222/93 |
| 3,265,249 | A | | 8/1966 | Jansson | |
| 3,451,705 | A | * | 6/1969 | Turpen | 292/218 |
| 4,079,860 | A | * | 3/1978 | Maves | 222/48 |
| 4,182,464 | A | * | 1/1980 | Orrey | 222/98 |
| 4,571,140 | A | | 2/1986 | Yamada et al. | |
| 4,574,982 | A | * | 3/1986 | Dehart et al. | 222/1 |
| 4,627,551 | A | | 12/1986 | Kopp | |
| 5,765,723 | A | | 6/1998 | Wilcox | |
| 6,196,420 | B1 | * | 3/2001 | Gutierrez et al. | 222/101 |
| 2010/0006594 | A1 | | 1/2010 | Mauger et al. | |
| 2010/0108717 | A1 | * | 5/2010 | Szymanski | 222/100 |
| 2012/0079930 | A1 | * | 4/2012 | Laurent et al. | 83/495 |

OTHER PUBLICATIONS

Finnish Search Report dated Jun. 21, 2012 corresponding to the Foreign Priority Application No. 20115866.

Extended European search report, dated May 26, 2015, in corresponding European Patent Application No. 12828857.8.

* cited by examiner

DISCHARGE DEVICE FOR AN ELASTIC PACKING CONTAINER AND METHOD FOR DISCHARGING AN ELASTIC CONTAINER

BACKGROUND OF THE INVENTION

1. Field of the Invention

The invention relates to a discharge device for discharging the contents of a container containing a viscous substance, the shell material of which container is elastic, which discharge device has a cylindrical winding roller and counter pressure roller, and an arrangement for pressing said rollers against each other, and a method for emptying a container with an elastic shell material.

2. Description of the Related Art

Industry often uses high viscosity substances, such as for example glues or sealing pastes or the like, which are administered to a use target. Due to the viscosity, aids are needed for emptying the substance from its container. One known manner to store and transport these substances to the use location are fixed-structure drum containers, from which the emptying occurs as aided by a conveying lid, i.e. the loose lid of the container is pressed into the container, whereby the content of the container is discharged. A problem with these is the relatively small size of the package, for example a barrel, whereby the container must often be changed, or if the package size is increased the emptying apparatus becomes impractically large and expensive. Additionally when changing the container, air and impurities may end up in the substance to be used, which may have an adverse effect on the substance properties. Additionally air, which has ended up in the system, may impede administration of the substance, which administration should be even and according to desire.

Said substances can be transported and stored also in sack-like containers, the shell of which is elastic. The emptying of these, especially as the size of the sack and the amount of substance it contains increase, is difficult, and situations may arise, where the flow speed of the substance emerging from the container varies, which makes its use difficult. Additionally substance is easily left inside these containers, i.e. the portion going to waste may be significant. Further it is difficult to keep the amount of discharged substance standard.

Patent publication US 2010/0006594 shows an apparatus for emptying an elastic sack-like container. The described apparatus comprises two rollers, which can be pressed against each other and the sack is pulled between them. The rollers move downward and simultaneously push out the content of the sack. The publication mentions that the rollers rotate by themselves or they have been equipped with a motor, which rotates them. The publication mentions that this can only increase the speed at which the content is removed. The outlet additionally has a pump, with which the outlet flow can according to the publication be further increased. This does however not strive for evenness of the outlet flow. This further requires an arrangement, which lifts the sack past the rollers. A forklift or a corresponding work machine is suggested as such. Work safety aspects must thus also be taken into account.

Patent publication U.S. Pat. No. 4,627,551 shows a device for emptying a sack containing a paste-like material. This has two adjacent rollers, both of which are rotated, and the sack to be emptied is fed between the rollers. The rollers are rotated with a hand crank and the movement of the rollers pushes the emptied sack upwards between them. The publication also mentions that the rollers are arranged so that friction keeps the sack in place if the emptying is stopped for a while. Such a method is in practice impossible to apply to a larger scale than a traditional sack. Attention has also not been paid to the evenness of the emptying.

BRIEF SUMMARY OF THE INVENTION

An object of the invention is a solution by which the drawbacks and disadvantages relating to the prior art can be considerably reduced. An object of the invention is especially a solution, with which high viscosity substances could be emptied from large elastic containers, so that the outflow would remain as controlled as possible.

The aims of the invention are obtained with a discharge device and a method, which are characterised in what is presented in the independent claims. Some advantageous embodiments of the invention are presented in the dependent claims.

The main idea of the invention is a discharge device, which has two rollers: a winding roller and a counter pressure roller. The inner part of the winding roller is hollow, a there is therein an attaching arrangement, where the shell material of the container to be discharged is attached. The winding roller, where the container is attached, is rotated so that the shell material of the container is wound around the winding roller and at the same time pressed between the rollers. The turning of said winding roller is adjusted so that the flow of content discharged from the container remains substantially at a set standard.

A discharge device according to one embodiment of the invention for discharging the contents of a container containing a viscous substance, the shell material of which container is elastic, has a cylindrical winding roller and counter pressure roller and an arrangement for pressing said rollers against each other. According to an advantageous embodiment of the invention the inner part of the winding roller in the discharge device is hollow and its shell has an opening, which has a lid part which can be opened. In the inner part of the winding roller there is an attaching arrangement for attaching an elastic container. In the lid part or in an edge of the opening in the shell of the winding roller or in both there is a shape for the shell material or another part of the container attached in the attaching arrangement. Such another part can for example be an aid in the container for the attaching. The discharge device additionally comprises an actuator for rotating the winding roller so that the shell material of the container attached to the attaching device is wound around the winding roller.

In one embodiment of the discharge device according to the invention the size of the container to be discharged is larger than 200 liters.

In a second embodiment of the discharge device according to the invention the actuator or a motor connected to the actuator adjusts the torque directed at the winding roller.

In a third embodiment of the discharge device according to the invention the counter pressure roller has an elastic coating.

In a fourth embodiment of the discharge device according to the invention the counter pressure roller is placed in relation to the winding roller in such a way that the point, where the shell material of the container starts to twist around the winding roller, is substantially between said rollers or close thereto.

In a fifth embodiment of the discharge device according to the invention the discharge device has a control part, which is arranged to control at least the torque of the winding roller as a function of the turning angle of the winding roller according to a control curve stored in the control part. The control curve can be a numeric file or a number of commands or the like. The control part implementing the control curve can also be implemented on a component level, whereby the control part does not need specific calculation capacity. The control curve can be formed or modified also in real-time for example based on measurements. In a sixth embodiment of the discharge device according to the invention the control curve is proportional to the used container, the properties of the substance to be discharged and the selected flow of the discharged content, and the control curve used by the control part can be changed.

In a seventh embodiment of the discharge device according to the invention the lid part that can be opened is shaped like the outer surface of the winding roller when in its place. In an eighth embodiment of the discharge device according to the invention the lid part has at least two parts and between the parts there are hinges, and the lid part is attached to the edge of the opening in the winding roller with hinges.

In a ninth embodiment of the discharge device according to the invention the container is arranged to be discharged into an outlet channel, which has means for measuring pressure and a sealing arrangement, which is arranged to stop the flow of discharged substance in the outlet channel, when the measure pressure falls under a given limit value. The sealing arrangement may be a pump, such as a screw pump, or a sealing valve or the like, with which the flow in the outlet channel can be stopped.

In a tenth embodiment of the discharge device according to the invention the discharge device has an arrangement for moving the discharge device or at least that part of the discharge device, where the winding roller and counter pressure roller are, in a vertical direction.

In an eleventh embodiment of the discharge device according to the invention the lifting arrangement has means for measuring force directed at the lifting arrangement, and based on the measured force the lifting arrangement is arranged to direct a positive or negative load to the discharge device or at least that part of the discharge device, where the winding roller and counter pressure roller are. With a positive load the lifting arrangement lifts the discharge device or some part of it, and with a negative load the lifting arrangement lowers the discharge device or some part of it. Naturally the magnitude of the load, i.e. the force which the lifting arrangement directs toward the discharge device, can be adjusted.

In a twelfth embodiment of the discharge device according to the invention the viscosity of the viscous substance is in the range of 100,000-1,500,000 mPas.

According to one embodiment of the method according to the invention the contents of a container containing a viscous substance and having an elastic shell material is discharged with a discharge device, which discharge device has a cylindrical winding roller and counter pressure roller and an arrangement for pressing said rollers against each other. According to one advantageous embodiment of the method according to the invention the inner part of the winding roller of the discharge device is hollow and in the shell of the winding roller there is an opening, which opening has a lid part which can be opened, and in the inner part of the winding roller there is an attaching arrangement for attaching an elastic container, and in the lid part or an edge of the opening in the shell or in both there is a shape for the shell material or another part of the container attached in the attaching arrangement, and the discharge device further comprises an actuator for rotating the winding roller. The method consists of steps, where the lid part is opened and the upper part of the container is attached in the attaching arrangement in the hollow inner part of the winding roller, and the lid part is closed so that the shell material or other part of the container remains in the shape and passes through it. The winding roller is rotated so that the shell material of the container is wound around the winding roller. The winding roller and counter pressure roller are pressed against each other so that the shell material of the container winding around the winding roller passes between the winding roller and the counter pressure roller. The turning of the winding roller is adjusted so that the flow of content discharged from the container remains substantially at a set constant.

In one embodiment of the method according to the invention the flow of content discharged from the container is kept substantially constant by adjusting the torque of the winding roller as a function of the turning angle of the winding roller.

In a second embodiment of the method according to the invention the discharge device has a control part, where a control curve is stored, which gives at least the torque of the winding roller as a function of the turning angle of the winding roller. This control curve is used for controlling the operation of the discharge device. In a third embodiment of the method according to the invention the control curve is proportional to the used container, the properties of the discharged substance and the selected flow of discharged content. In a fourth embodiment of the method according to the invention the container is discharged into an outlet channel and the torque of the winding roller is adjusted according to a pressure measured from the container or outlet channel. In a fifth embodiment of the method according to the invention the container is discharged into an outlet channel and the outlet channel has a sealing arrangement, which closes when the pressure in the outlet channel falls under a given limit value.

In a sixth embodiment of the method according to the invention the discharge device or the part of the discharge device, where at least the winding roller and counter pressure roller are, is lifted after the upper part of the container is attached and before starting the rotation of the winding roller in order to tighten the shell material of the container, and the discharge device is lowered at least at some times during the winding of the shell material around the winding roller. The discharge device can also be lifted when the container empties or when the container is close to emptying, in order to prevent the shell material of the container from ending up in the outlet channel.

In a seventh embodiment of the method according to the invention a force directed by the container at the container discharge device or at the part of the discharge device, where at least the winding roller and the counter pressure roller are, is measured, and based on this measurement a positive or negative load is directed to the discharge device or the part of the discharge device, where at least the winding roller and the counter pressure roller are.

An advantage of the invention is that it can be used for efficiently emptying containers manufactured from an elastic shell material. It can particularly be used for keeping the flow of material emerging from the container substantially standard during the entire emptying of the container, whereby the process, where material taken from the container is used, is made more efficient and its reliability is improved. The invention can quickly be adapted for different containers and different processes. The invention is especially suited for emptying high viscosity substances from elastic containers, the emptying of which is otherwise difficult. A substance can be seen as having high viscosity, if its viscosity is 100,000-1,500,000 mPas.

An advantage of the invention is that it is usable in industrial conditions, where it is useful to use large containers. The invention also makes possible automation of the emptying of containers.

A further advantage of the invention is that it can be used to reduce the amount of air or other impurities ending up in the material to be taken out of the container during the changing of containers.

A further advantage of the invention is that it can reduce the amount of material going to waste, i.e. being left in the container.

The invention further makes possible an increase in work safety by reducing possible danger situations in the emptying of containers.

BRIEF DESCRIPTION OF THE DRAWINGS

In the following, the invention will be described in detail. In the description, reference is made to the enclosed drawings, in which.

DETAILED DESCRIPTION OF THE PREFERRED EMBODIMENTS

Figure 1:
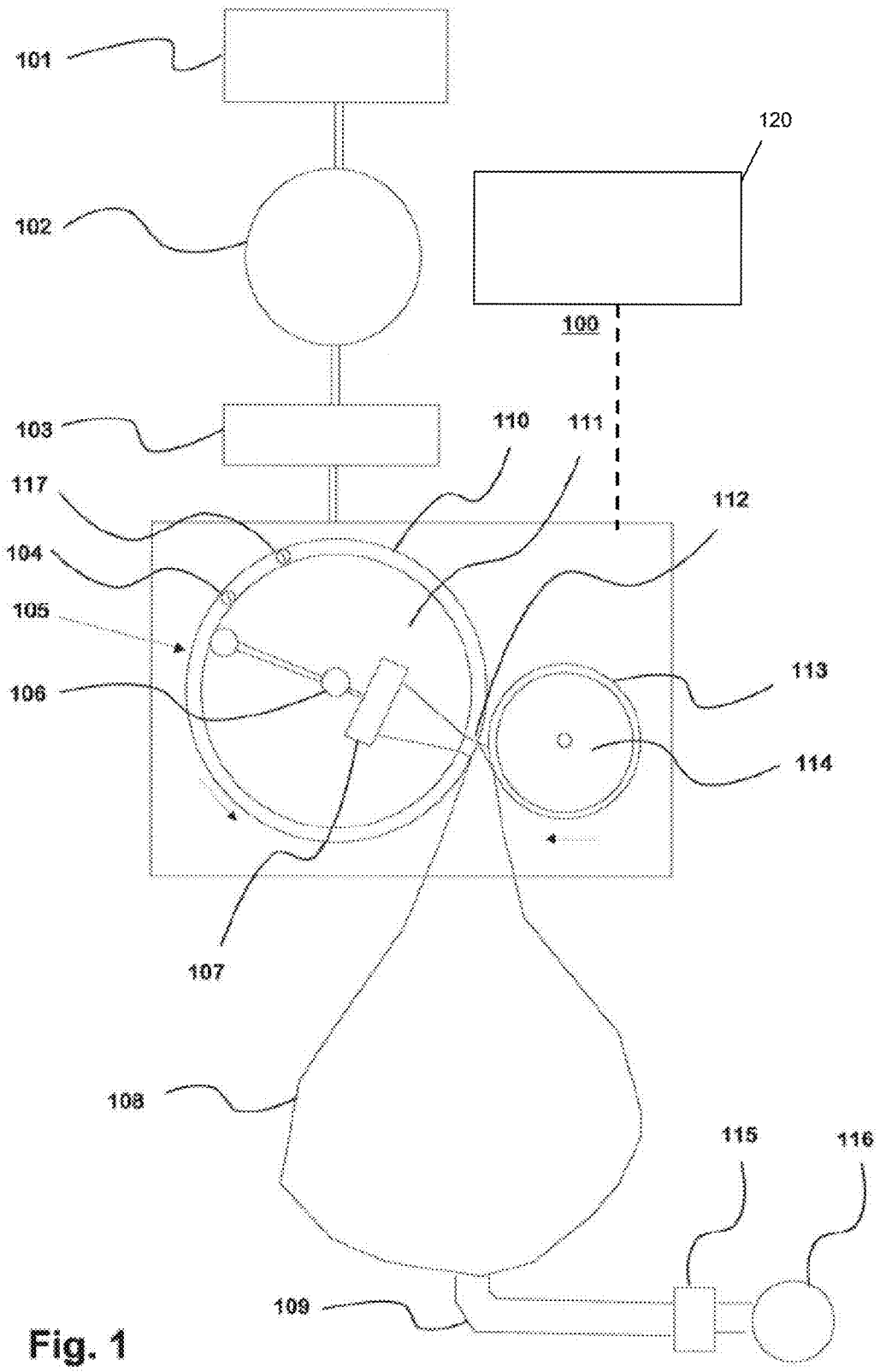
FIG. 1 shows an example of a discharge device according to the invention.

FIG. 1 shows as an example a discharge device 100 according to the invention for discharging a container 108. The shell material of the container is elastic, i.e. the outer surface of the container changes its shape according to the amount and properties of the material inside the container and according to the position of the container. The container can be sack-like or bag-like. An upper part 107 and a lower part can be defined for the container. The container is attached to the discharge device by its upper part and the substance contained in the container is discharged from the container from its lower part. In the case according to the example the lower part of the container is attached to an outlet channel 109. The material contained in the container is discharged into the outlet channel and led from there to its use purpose. The outlet channel according to the example has means for measuring pressure 115 and a sealing arrangement 116. When the measured pressure bypasses some given limit value, the sealing arrangement closes. Thus for example air is prevented from getting into the material to be administered. In the case according to the example the bottom of the container is at a standard height.

The discharge device 100 has a winding roller 105 and a counter pressure roller 114. The rollers are cylindrical, and they are placed in the discharge device to be parallel and so that they press the container between them. The rollers are manufactured from some material suitable for the use purpose, such as for example metal or ceramics. The discharge device has an arrangement, with which the winding roller and counter pressure roller are pushed toward each other. This arrangement can be implemented for example with a motor, springs, pressurised air or adjustable hydraulics or in a corresponding way. The arrangement may be directed to either one or both of the rollers. I.e. one roller is in its place and the other is pushed against it or both are pushed against each other. The rollers are advantageously cambered, i.e. somewhat thicker in the middle part than at their ends. This can have been implemented for example with a coating or during manufacturing of the roller.

The winding roller 105 has a hollow inner part 111. The shell of the winding roller has an opening, which has a lid part 110. The lid part can be opened so that the inner parts of the winding roller can be reached. The lid part covers the opening and is shaped so that when the lid part is closed, its shape does not substantially deviate from the outer surface of the winding roller, i.e. the shape of the lid part conforms to the shape of the outer surface of the winding roller. Thus the rollers can press against each other without disturbance from the lid part. In the figure the lid part is closed. In the case according to the example, the lid part is attached to the edge of the opening in the winding roller with hinges 104. The lid part has two parts and these parts are separated with hinges 117. The fact that it has two parts makes possible that the opening of the lid part and the attaching of the container is easier. A two-part and hinged lid part can be folded when opened, whereby it for example does not touch the container to be set into place. The lid part can also have more parts or it can consist of one part. The lid part has some locking arrangement for locking it into place, so that it does not open by mistake during use of the discharge device. This locking arrangement is connected for example by pushing the lid part with the counter pressure roller. The lid part can be equipped with an automatic or partly automatic opening arrangement, which functions for example with gas springs. This opening arrangement for example opens the lid part, when the shell material of the container has been removed from around the winding roller.

In the edge of the lid part there is a shape 112, which leaves open a part of the opening in the shell of the winding roller when the lid part is in its place and closed. In the case according to the example this shape is in the side of the lid part, which is opposite to the side where the hinges are. This shape can also be in the side of the opening in the shell of the winding roller or in the side of the opening and in the lid part, whereby they together form the part of the opening which remains open.

In the hollow inner part 111 of the winding roller there is an attaching arrangement 106 for attaching the upper part 107 of the container to the winding roller. The attaching arrangement is advantageously attached to a wall of the inner part. Additionally the attaching arrangement is in such a part of the inner part of the winding roller that it can easily be reached through the opening in the shell of the winding roller, when the lid part 110 is opened. In the case according to the example the attaching point of the attaching arrangement is on a wall of the inner part of the winding roller, opposite to the open part of the opening formed by the shape 112 in the lid part. The part of this opening which remains open is of such a size that the shell material of a container attached in the attaching arrangement fits through it, when the lid part is in its place. The attaching point or attaching points of the attaching arrangement in the inner part of the winding roller can vary between different embodiments of the attaching arrangement. The attaching arrangement is advantageously of a so-called bayonet catch type, where the upper part of the container can quickly be connected to the attaching arrangement. Further in the case according to the example the attaching arrangement extends close to the open part of the opening, whereby the attaching of the container is made easier and the part of the shell material of the attached container remaining inside the winding roller is smaller compared to a case, where the point in the attaching arrangement where the container is attached is farther from the open part of the opening. An embodiment can also be made, where the container already has a part of the attaching arrangement or it is connected thereto, which part is attached to the inner part of the winding roller when the container is attached to the discharge device.

The discharge device 100 according to the example has an actuator 102, with which the winding roller 105 is rotated. The actuator is some motor suitable for the purpose, which has power transmission means for rotating the winding roller. The torque caused by the motor in the arrangement can be controlled. Between the actuator and the winding roller or included in the actuator there is a torque member 103, such as for example a chain gear or a transmission box. The torque member is used for transmitting the torque to the winding roller. The discharge device has a control part 101, which controls the motor. A control curve or several control curves can be stored in the control part, which control curves can be used for controlling the motor. The control curve gives the torque for example as a function of the turning angle of the winding roller. The control part can control the motor providing the torque for example also based on a pressure measured from the container or based on the flow of substance emerging from the container. Thus it is attempted to keep the pressure and flow at a given constant by adjusting the torque of the motor. Additionally in some cases the speed, with which the winding roller is rotated, can be adjusted in addition to or instead of the torque. With the actuator the winding roller can be rotated in both directions.

When the winding roller 105 is rotated with the actuator 102, the shell material of the container 108 attached to the attaching arrangement 106 in the above-described manner starts to twist around the winding roller. The rotational direction of the winding roller is such that the shell material of the container goes between the rollers from below. The rotational directions of the rollers are marked with arrows in FIG. 1. The winding roller and counter pressure roller 114 are pressed against each other and simultaneously press the container passing between them. Thus a pressure is directed at the material contained in the container and it is pressed out from the container for example through an outlet channel 109. This flow of emerging material is kept constant by adjusting the torque directed at the winding roller. Depending on the sizes of the container and winding roller, the shell material of the container is wound around the winding roller in one or more laps. In some cases the container can be emptied during an incomplete lap. The winding angles generally vary in the range of 360°-1440°, i.e. from one to four laps. The length of the winding roller is advantageously so great that the shell material of the container winding around it does not extend over the ends of the winding roller. The length of the counter pressure roller is such that it extends over the shell material of the container winding around the winding roller.

The counter pressure roller 114 can roll freely or it is rotated by a motor. The counter pressure roller is coated with an elastic coating 113. This coating yields when shell material of the container is left between the winding roller and the counter pressure roller. The coating is intended for boosting the pressing and for avoiding breakage of the shell material of the container, when shell material is accumulated between the rollers. A corresponding elastic coating can in some embodiments be arranged also on the outer surface of the winding roller and its lid part. In the case according to the example the counter pressure roller has a smaller diameter than the winding roller. The rollers can of course also have another size. The counter pressure roller is advantageously placed so that the point, where the shell material of the container begins to twist around the winding roller, is substantially between the rollers or close thereto.

The discharge device 100 has a lifting arrangement 120, with which the discharge device or at least the part of the discharge device, where the rollers are, can be moved in a vertical direction, i.e. up or down. The lifting arrangement is dimensioned so that it is able to move the discharge device also when a container 108 is attached to it. One lifting arrangement for example has a motor, an axis and a moving arrangement, such as chains, which connect the discharge device and the axis rotated by the motor. The lifting arrangement can be used for assisting the discharge event of the container. For example after the container is attached, the discharge device can be lifted before the rotating of the winding roller is begun, in order to tighten the shell material of the container. A lifting can also be necessary for example for connecting an outlet channel 109 to the container. The discharge device can also be lowered during the emptying of the container, so that the outlet channel does not need to be moved as the shell material of the container is wound around the winding roller. In the end stage of the discharge of the container the discharge device can be lifted, so that the slacking shell material of the container does not end up in the outlet channel. The movements of the lifting arrangement can be controlled with the control unit 101 and they can be stored in the control curve. The lifting arrangement can also have its own control arrangement.

Advantageously the lifting arrangement has a force sensor, with which the force directed at the discharge device can be measured. When the discharging of the container is going on, this measured force is proportional to the force directed at the discharge device by the container 108. During the discharging the discharge device is lowered according to the force sensor's measurements. Thus the lifting arrangement can be used to monitor the situation, when the winding roller starts to support the container and thus lower the discharge device, in order to avoid additional strain directed at the apparatus. The sack is thus allowed to lower, at the same time as it is wound around the winding roller. These movements of the lifting arrangement can also be controllable by the control unit 101 and storable in the control curve. The lifting arrangement is thus arranged to function automatically. The lifting arrangement can also have been equipped with a limit switch, which stops the movement of the lifting arrangement in some point, for example to prevent the shell material of the container or the discharge device from ending up too low or too high.

The lifting arrangement can additionally have a force sensor, which is used for measuring the force caused by the discharge device and container on the lifting arrangement. With the aid of the readouts of the force sensor, the movements of the lifting arrangement and the burden directed at the discharge device can be adjusted. For example in the beginning of the discharge event the lifting directs a force of 2000 N onto the discharge device, whereby the force directed by the container onto the winding roller decreases. At the same time the lifting arrangement can lower the discharge device, so that the shell material of the container does not tighten too much and the container for example detaches from the outlet channel. As the discharge event continues and the container becomes lighter as it empties, the force directed by the lifting arrangement onto the discharge device is advantageously decreased close to 0 N. This can be automated in the control of the lifting arrangement or included in the control curve, whereby the control part 101 also controls the function of the lifting arrangement. The lifting arrangement can also have manual control.

Figure 2:
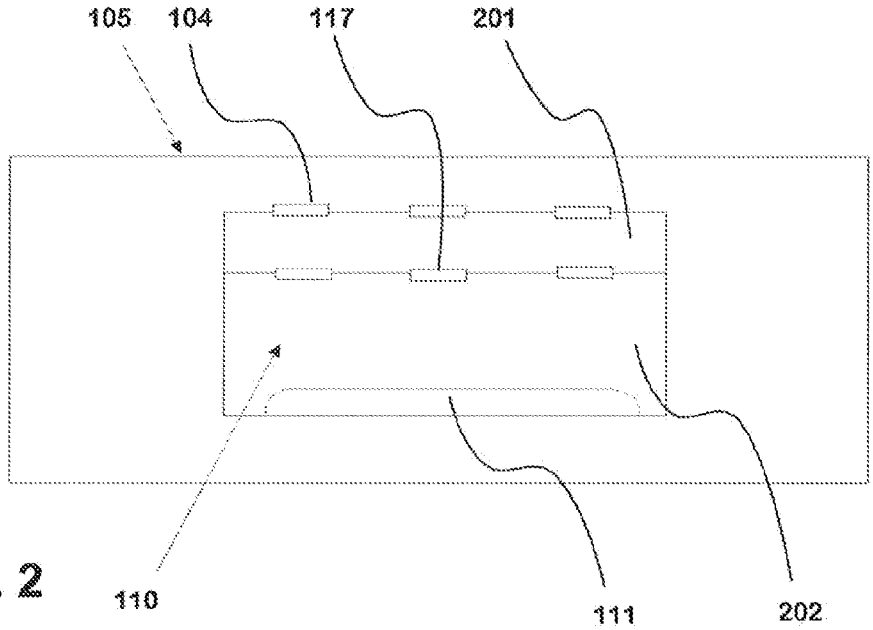
FIG. 2 shows an example of a winding roller of a discharge device according to the invention.

FIG. 2 shows an example of a winding roller 105 examined in such a way that its axis is in the direction of the surface of the figure. The lid part 110 is closed in the opening of the winding roller. The lid part is attached to the shell of the winding roller with hinges 104. The lid part has a shape 111, wherein the shell material of the container attached inside the winding roller is placed. The lid part has two parts. It has a first part 201 and a second part 202. The first and second part are connected together with hinges 117. In one embodiment the length of the winding roller is 800 mm and the length of the lid part is 400 mm. The height of the shape is 15-20 mm and can extend over the entire length of the lid part or a part of it. In the example of the figure the ends of the shape are rounded.

In order to open the lid part in a controlled manner there may be different power means in the winding roller and between the parts of the lid part, such as for example gas springs. When the lid part is closed, the power means are in an excitation state. When the locking of the closed lid part is removed, the power means can extend. Thus they open the lid part. Due to the hinging, the lid part can be turned out of the way for example when the container is attached to the winding roller.

Figure 3:
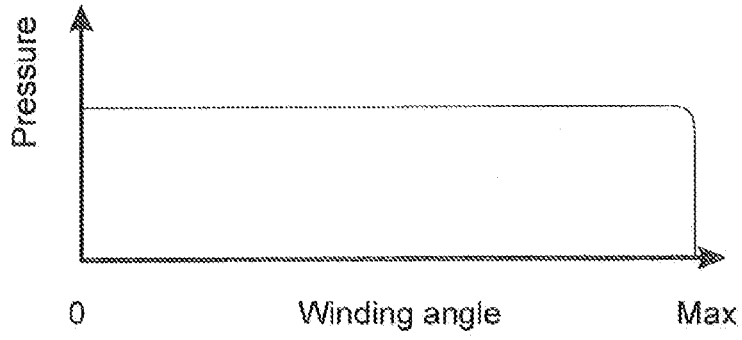
FIG. 3 shows the pressure in the outlet channel produced by the discharge device according to the invention as a function of the winding angle.
Figure 4:
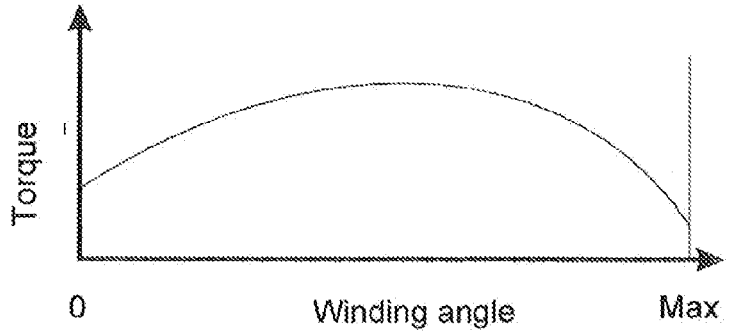
FIG. 4 shows a control curve of a discharge device according to the invention as a function of the torque and winding angle, which control curve produces a pressure curve according to FIG. 3

FIG. 3 shows an example of the pressure in the outlet channel produced by a discharge device according to the invention as a function of the winding angle. The winding angle varies from zero, i.e. the starting point, to the maximum, where the rotation of the winding roller is stopped. When the winding angle is 0° the container is full, and when the winding angle is at its maximum the container is substantially empty. The pressure remains constant, i.e. the amount of substance flowing out of the container is constant, until approaching the maximum value of the winding angle. FIG. 4 shows a control curve of a discharge device as a function of the torque and winding angle, which control curve produces a pressure curve according to FIG. 3. In the example the torque is at its minimum, when the winding angle is 0° or the maximum. The torque is at its maximum substantially in the mid stages of the emptying process. From the curve can be seen that when approaching the maximum of the winding angle, the torque curve is steeper than in the beginning stage. Although in the example the torque is adjusted to keep the flow of substance emerging from the container standard, other variables can also be placed in the control curve, such as for example the vertical movement of the discharge device or the rotation speed of the winding roller. By changing the control curve the discharge speed can for example be adjusted, for example if different targets need a different amount of the substance contained in the container.

Figure 5:
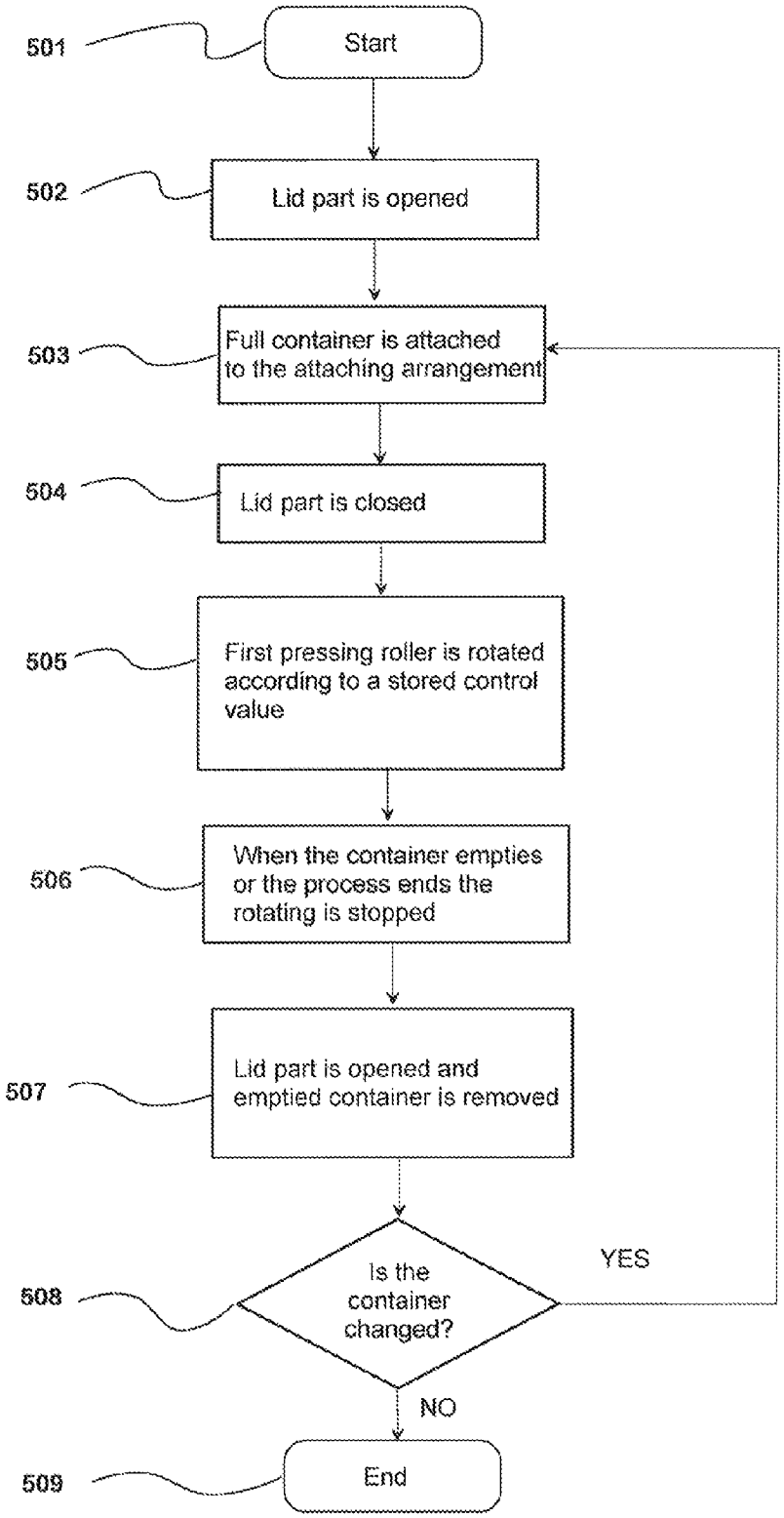
FIG. 5 shows as an example a method according to the invention as a flow chart.

FIG. 5 shows an example of the use of the method according to the invention as a flow chart. In step 501 the emptying of the container is begun. If necessary, the discharge device is lowered. The lid part of the container is opened in step 502. The upper part of a full container is attached to an attaching arrangement inside the winding roller in step 503. The lid part is closed in step 504. The discharge device and at the same time the full container can if necessary be lifted higher. An outlet channel is attached to the lower part of the container, or use of the material contained in the container is prepared for in another way.

In step 505 the rotating of the winding roller is begun. The torque of the motor is adjusted according to a control curve in the control part. The shell material of the container starts to twist around the winding roller and passes between the winding roller and the counter pressure roller. Thus a pressure starts to be directed at the material contained in the container as the shell material of the container tightens around the contents and material starts to discharge into the outlet channel. The torque changes in accordance with the control curve, so that the flow of material into the outlet channel is constant. The shell material of the container can twist around the winding roller by many laps. If necessary an arrangement, which presses the winding roller and counter pressure roller against each other, can reduce the pressing between the rollers or change the distance between them as the amount of shell material of the container around the winding roller grows.

In step 506 when the container empties or the process otherwise ends, the rotation is stopped. The outlet channel is advantageously closed when the pressure starts to decrease before the rotation is stopped. The container is detached from the outlet channel and the winding roller is rotated in the opposite direction to when the container was emptied, so that the shell material of the container wound around the winding roller can be removed. The discharge device can when necessary be moved in the vertical direction. It can for example be lowered, so that the lid part of the container can be opened and the shell material can more easily be detached from the attaching arrangement in step 507.

In step 508 a decision is made regarding whether the emptying of containers is continued. If a new container does not need to be emptied, the process is ended in step 508. If it is desired to empty a new container, the process moves to step 503 and a full container is attached to the discharge device.

Some advantageous embodiments according to the invention have been described above. The invention is not limited to the solutions described above, but the inventive idea can be applied in numerous ways within the scope of the claims.

The invention claimed is:

1. A discharge device for discharging content of a container containing a viscous substance, a shell material of the container being elastic, the discharge device comprising:

a cylindrical winding roller having a shell defining a hollow inner part, the cylindrical winding roller including an attaching system for selective attachment to the elastic container be attached, the attaching system being provided in the inner part of the cylindrical winding roller, the shell of the cylindrical winding roller having a first opening to which a hinged and openable lid part is installed, and a second opening for selective receipt of material of the shell of the container for attachment of the shell material in the attaching system is provided, the second opening being defined between the lid part and the shell of the winding roller;

a counter pressure roller, the cylindrical winding roller and the counter pressure roller being selectively pressed together; and an actuator selectively rotating the winding roller so that the shell material of the container attached in the attaching system is wound around the winding roller.

2. The discharge device according to claim 1, wherein the size of the container to be discharged is larger than 200 liters.

3. The discharge device according to claim 1, wherein the actuator is a motor connected to a an actuator selectively adjusting the torque rotating the winding roller.

4. The discharge device according to claim 1, wherein the counter pressure roller has an elastic coating.

5. The discharge device according to claim 1, wherein the counter pressure roller is placed in relation to the winding roller so that a point, where the shell material of the container starts to twist around the winding roller, is substantially between said rollers or close thereto.

6. The discharge device according to claim 1, wherein the discharge device has a control part selectively controlling at least the torque of the winding roller as a function of a turning angle of the winding roller according to a control curve stored in the control part.

7. The discharge device according to claim 6, wherein the control curve is proportional to the container, the properties of the substance to be discharged and the selected flow of the discharged content, and the control curve used by the control part is changeable.

8. The discharge device according to claim 1, wherein the lid part is shaped so that when closed, the shape of the lid part conforms to a shape of an outer surface of the winding roller.

9. The discharge device according to claim 8, wherein the lid part has a first part and a second part, second hinges and provided between the first part and the second part, and the lid part is attached to an edge of the first opening in the winding roller with first hinges disposed between the first part of the lid and the shell of the winding roller.

10. The discharge device according to claim 1, wherein the container is selectively discharged into an outlet channel, the outlet channel including a sealing system stopping the flow of discharged substance in the outlet channel when a measured pressure falls under a given limit value in the outlet channel.

11. The discharge device according to claim 1, wherein the discharge device or at least the part of the discharge device at which the winding roller and counter pressure roller are disposed are selectively moved in a vertical direction by a lifting system.

12. The discharge device according to claim 11, wherein a force directed at the lifting system is measured, and based on the measured force, the lifting system directs a positive or negative load to the discharge device or at least the part of the discharge device at which the winding roller and counter pressure roller are disposed.

13. The discharge device according to claim 1, wherein the viscosity of the viscous substance is in the range of 100,000-1,500,000 mPas.

14. A method for discharging content of a container containing a viscous substance and having an elastic shell material with a discharge device, the discharge device including a cylindrical winding roller, a counter pressure roller, a pressing system selectively pressing said rollers against each other, and an actuator selectively rotating the winding roller, an inner part of the winding roller being hollow, the shell of the winding roller having a first opening having a lid part that is selectively opened, an attaching system for selective attachment to an upper part of the elastic container, the attaching system being provided in the inner part of the winding roller, a ring portion being disposed in the lid part for the shell material or another part of the container to be attached in the attaching system, the method comprising:

opening the lid part and attaching the upper part of the container in the attaching system in the hollow inner part of the winding roller, and closing the lid part so that the shell material or other part of the container remains in the ring portion;

rotating the winding roller by the actuator so that the shell material of the container is wound around the winding roller;

pressing the winding roller and the counter pressure roller against each other so that the shell material of the container winding around the winding roller passes between the winding roller and the counter pressure roller; and adjusting the turning of the winding roller so that a flow of content discharged from the container remains substantially at a set constant.

15. The method according to claim 14, further comprising adjusting the torque of the winding roller as a function of the turning angle of the winding roller to maintain the flow of content discharged from the container substantially constant.

16. The method according to claim 14, wherein the discharge device has a control part in which control curve data is stored, which provides at least the torque of the winding roller as a function of the turning angle of the winding roller.

17. The method according to claim 16, wherein the control curve is proportional to the container, properties of the substance to be discharged, and the flow of discharged content.

18. The method according to claim 14, wherein the container is discharged into an outlet channel, and the torque of the winding roller is adjusted according to a pressure measured from the container or outlet channel.

19. The method according to claim 14, wherein the container is discharged into an outlet channel, and the outlet channel has a sealing system, which stops the flow of discharged substance in the outlet channel, when the pressure in the outlet channel falls under a given limit value.

20. The method according to claim 14, wherein the discharge device or the part of the discharge device at which at least the winding roller and counter pressure roller are disposed is lifted after the upper part of the container is attached and before starting the rotation of the winding roller in order to tighten the shell material of the container, and the discharge device is lowered at least at some times during the winding of the shell material around the winding roller.

21. The method according to claim 14, wherein a force directed by the container at the discharge device or at the part of the discharge device at which at least the winding roller and the counter pressure roller are disposed is measured, and based on the measured force, a positive or negative load is directed to the discharge device or the part of the discharge device at which at least the winding roller and the counter pressure roller are disposed.

* * * * *